US007229161B2

(12) United States Patent
Satake

(10) Patent No.: US 7,229,161 B2
(45) Date of Patent: Jun. 12, 2007

(54) PIEZOELECTRIC INK JET HEAD

(75) Inventor: Kenichi Satake, Soraku-gun (JP)

(73) Assignee: Kyocera Corporation, Kyoto (JP)

( * ) Notice: Subject to any disclaimer, the term of this patent is extended or adjusted under 35 U.S.C. 154(b) by 150 days.

(21) Appl. No.: 10/852,530

(22) Filed: May 24, 2004

(65) Prior Publication Data

US 2004/0239731 A1 Dec. 2, 2004

(30) Foreign Application Priority Data

May 30, 2003 (JP) ..... 2003-155299

(51) Int. Cl.
*B41J 2/045* (2006.01)

(52) U.S. Cl. ..... 347/71

(58) Field of Classification Search ..... 347/68, 347/69–72

See application file for complete search history.

(56) References Cited

U.S. PATENT DOCUMENTS 6,402,303 B1 * 6/2002 Sumi ..... 347/68
6,471,342 B1 10/2002 Horio et al. ..... 347/70

FOREIGN PATENT DOCUMENTS

| | | |
|---|---|---|
| EP | 0 974 465 | 1/2000 |
| EP | 1 245 390 | 10/2002 |
| GB | 2 288 766 | 11/1995 |
| JP | 5-318731 | 12/1993 |
| JP | 11-34323 | 2/1999 |

* cited by examiner

*Primary Examiner*—K. Feggins
(74) *Attorney, Agent, or Firm*—Hogan & Hartson LLP

(57) ABSTRACT

The present invention is directed to a piezoelectric ink jet head wherein contacts for the electrical connection of the upper and lower electrodes that sandwich the piezoelectric element on the upper and lower sides are disposed in a solid region of the substrate where any of recess to make the pressure cavity, common feed path, feed port, nozzle passage or nozzle is not formed, in order to surely prevent the vibration characteristic of individual drive regions or individual piezoelectric element from varying.

2 Claims, 5 Drawing Sheets

PIEZOELECTRIC INK JET HEAD

This application is based on application No. 2003-155299 filed with the Japanese Patent Office, the content of which is incorporated hereinto by reference.

TECHNICAL FIELD

The present invention relates to a piezoelectric ink jet head and, more particularly, to a piezoelectric ink jet head that can be preferably used in printer, copier, facsimile, and a composite machine which combines some of the former.

BACKGROUND OF THE INVENTION

For a piezoelectric ink jet head that uses the electrostrictive effect of a piezoelectric element as the drive power source and is employed in an on-demand type ink jet printer, one having such a constitution is widely employed that comprises a plurality of pressure chambers to be filled with an ink disposed on one side of a plate-shaped substrate along the surface, with a nozzle for discharging the ink provided to communicate with each of the pressure chambers and a drive section including the piezoelectric element provided for each of the pressure chambers, as described in Japanese Unexamined Patent Publication JP-H-05-318731-A2 (1993).

In the piezoelectric ink jet head described above, a drive voltage is individually applied to one or more of the piezoelectric elements each corresponding to each of the pressure chambers so as to deform, thereby decreasing the volume of the pressure chamber that corresponds to the piezoelectric element, so that the ink contained in the pressure chamber is discharged from the nozzle that communicates therewith in the form of ink droplet and a dot is formed on a sheet of paper.

More specifically, a drive section comprising the piezoelectric element and an oscillator plate that supports the piezoelectric element transmits a force generated by the piezoelectric element as a pressure to the ink contained in the pressure chamber, thereby to function as a drive power source that discharges ink droplets through the nozzles that communicate with the pressure chambers. That is, the drive section causes the piezoelectric element to deform due to the drive voltage applied thereto, so that the oscillator plate is caused to deflect and protrude toward the pressure chamber, thereby decreasing the volume of the pressure chamber and pressurizing the ink in the pressure chamber, so that an ink droplet is discharged from the tip of the nozzle.

At the same time, since the oscillator plate is caused by the pressure of the ink contained in the pressure chamber to deflect in a direction opposite to that described above, the drive section also acts as an elastic body with respect to the vibration of the ink in the head.

When a drive voltage is applied to the piezoelectric element so as to generate a force, the ink contained in the head undergoes vibration under the pressure transmitted via the oscillator plate from the drive section. This vibration is generated as the drive section and the pressure chamber act as the elasticity against the inertia of a feeder port that feeds the ink to the pressure chamber, a nozzle passage that communicates with the pressure chamber and the nozzle, and the nozzle. Natural period of vibration of volumetric velocity of the ink contained in the head during this vibration is determined by the dimensions of the components described above, physical properties of the ink and dimensions and physical properties of the drive section.

In the piezoelectric ink jet head, an ink droplet is discharged by utilizing the vibration of ink meniscus in the nozzle due to the vibration of the ink described above, thereby forming a dot on the paper surface.

In order to achieve a higher resolution of the piezoelectric ink jet head while decreasing the size of the piezoelectric ink jet head, pitch of arranging the nozzles must be made as small as possible. When resolution of the piezoelectric ink jet head becomes higher and the number of nozzles increases, however, it becomes difficult to dispose the independent piezoelectric elements individually in correspondence to the pressure chambers. For this reason, it has recently become a prevailing practice to employ a piezoelectric ink jet head having a piezoelectric element made in a thin plate of transverse vibration mode that is formed integrally with an electrode (common electrode), lower (oscillator plate side) one of a pair of electrodes that are disposed to sandwich the piezoelectric element for applying the drive voltage to the piezoelectric element, and the oscillator plate, in such a size that covers the plurality of pressure chambers (hereinafter referred to as a "common element type"). Of the pair of electrodes, the electrode that is disposed over the piezoelectric element (individual electrode) is separately formed in a predetermined shape that corresponds to each pressure chamber for applying drive voltage individually to each piezoelectric element.

In the piezoelectric ink jet head of common element type, when an electric field is generated by applying the drive voltage from the individual electrode to the region sandwiched by the individual electrode and the common electrode in the plane of the piezoelectric element (hereafter referred to as a "drive region"), the drive region can be driven like an independent piezoelectric element thereby pressurizing the ink in the corresponding pressure chamber.

In order to individually apply drive voltages to the individual electrodes and ground the common electrode in the piezoelectric ink jet head of common element type described above, electrical connection must be established for the electrodes by soldering leads or using crimp terminals.

As taught in Japanese Unexamined Patent Publication JP-H11-34323-A2 (1999), making electrical connection within the area of the pressure chamber leads to a problem of variability in vibration characteristic of the piezoelectric element among the drive regions, due to the variability in rigidity and/or weight of the solder in the case of soldering, and due to the variability in crimping force in the case of using crimp terminals. For this reason, Japanese Unexamined Patent Publication JP-H11-34323-A2 proposes to make electrical connection of the electrodes outside of the area of the pressure chamber.

The present inventors studied the possibility of improving the vibration characteristic of individual drive regions of the piezoelectric ink jet head of common element type, and improving the vibration characteristic of the individual piezoelectric elements of the conventional piezoelectric ink jet head having the piezoelectric elements separately formed for the individual pressure chambers (hereafter referred to as a "separate element type"), by making the oscillator plate thinner than that of the prior art, specifically setting the ratio $t_1/t_2$ of the thickness of the piezoelectric element $t_1$ to thickness of the oscillator plate $t_2$ in a range from 1/1 to 1/4.

In such a piezoelectric ink jet head having thinner oscillator plate, however, it was found that it is not sufficient to make electrical connection of the electrodes outside of the area of the pressure chamber, and the possibility of vibration characteristic differing among the vibration regions or among the individual piezoelectric elements remains.

SUMMARY OF THE INVENTION

An object of the present invention is to provide a piezoelectric ink jet head that can prevent the vibration characteristic from varying among the drive regions or among the individual piezoelectric elements more surely than in the prior art.

In order to achieve the object described above, the present inventors investigated the structure of the piezoelectric ink jet head described in JP-H11-34323-A2.

Through the investigation, the inventor obtained the following finding: Although the electrical connections of the electrodes are made outside the area of the pressure chamber in the piezoelectric ink jet head described in the patent publication, no consideration was given to connecting the electrodes while avoiding such a region where there is a cavity in the substrate such as common feed path, feed port for supplying the ink to the pressure chambers or the like. In case electrical connection to the electrode is made in a region where there is such a cavity is formed inside, vibration characteristic varies among the drive regions and among the piezoelectric elements, due to the variability in rigidity and/or weight of the solder in the case of soldering, and due to the variability in crimping force in the case of using crimp terminals.

A region of the substrate where there is a cavity formed inside has lower rigidity than a solid region where there is no cavity. Also because cavities such as the common feed path, the feed port and the like are disposed in the vicinity of the pressure chamber, making electrical connection to the electrode is made on the surface of a region of the substrate where there is a cavity formed inside thereof has adverse effects on the vibration characteristic of the individual drive regions or of the individual piezoelectric elements located above the pressure chambers, as the variability in rigidity and/or weight of the solder or the variability in the crimping force influences the rigidity of the substrate in such regions, and is transmitted via the thin oscillator plate to the drive regions and/or the piezoelectric elements.

This leads to the problem of why no consideration was given to the effect of cavities in JP-H-11-34323-A2. It is because thickness of the oscillator plate $t_2$ is set fairly larger than thickness of the piezoelectric element $t_1$ ($t_1/t_2=1/7.5$) in the piezoelectric ink jet head described in the patent publication, so that the thick oscillator plate has a high rigidity and is less subject to the effect of the internal structure of the substrate (refer to the paragraph [0032] of the patent publication). However, the oscillator plate is influenced by the effect of the internal structure of the substrate and the associated problem of rigidity, in case the oscillator plate has a thickness in the range described above.

In case contacts for the electrical connection of the electrodes are positioned in a solid region of higher rigidity where the substrate does not have any cavity formed therein such as the recess to make the pressure chamber, the common feed path, the feed port, the nozzle passage or the nozzle, in contrast, the vibration characteristic can be surely prevented from varying among the drive regions or among the individual piezoelectric elements even when the oscillator plate has a thickness in the range described above.

Thus the invention described in claim 1 is a piezoelectric ink jet head comprising a plate-shaped substrate with a plurality of recesses that form pressure chambers to be filled with ink being formed in the direction of substrate surface on one side of the substrate, while the nozzles for discharging the ink contained in the pressure chambers in the form of droplets are disposed so as to communicate with the respective recesses via a nozzle passages, and the common feed path is disposed to communicate via a feed port with the recesses for supplying the ink to the pressure chambers, the substrate being provided, on the surface thereof where the recesses are formed, with a drive section comprising:

a piezoelectric element made in a thin plate of transverse vibration mode;

an oscillator plate that closes the recesses so as to form the pressure chambers and oscillates as the piezoelectric element deforms thereby to decrease the capacity of some of the pressure chambers and discharge the ink from the pressure chamber through the nozzle in the form of droplet; and upper and lower electrodes that sandwich the piezoelectric element on the upper and lower sides, wherein the contacts for the electrical connection of the electrodes are positioned in a solid region of the substrate where any of recess to make the pressure chamber, common feed path, feed port, nozzle passage or nozzle is not formed.

In the piezoelectric ink jet head of the present invention, in order to improve the vibration characteristic of individual drive regions of the piezoelectric ink jet head of common element type, and improve the vibration characteristic of the individual piezoelectric elements of the piezoelectric ink jet head of separate element type when drive voltage is applied to the piezoelectric element having thin plate shape of transverse vibration mode, it is preferable to set the ratio $t_1/t_2$ of the thickness of the piezoelectric element $t_1$ to thickness of the oscillator plate $t_2$ in a range from 1/1 to 1/4.

Thus the invention described in claim 2 is the piezoelectric ink jet head according to claim 1, wherein the ratio $t_1/t_2$ of the thickness of the piezoelectric element $t_1$ to the thickness of the oscillator plate $t_2$ is set in a range from 1/1 to 1/4.

In the piezoelectric ink jet head of the present invention, in order to further improve the vibration characteristic of individual drive regions of the piezoelectric ink jet head of common element type, and improve the vibration characteristic of the individual piezoelectric elements of the piezoelectric ink jet head of separate element type when the drive voltage is applied to the piezoelectric element having thin plate shape of transverse vibration mode and to simplify the layer constitution, it is preferable to form the oscillator plate from an electrically conductive material and integrally with the lower electrode, among the upper and lower electrodes that sandwich the piezoelectric element on the upper and lower sides.

Therefore, the invention described in claim 3 is the piezoelectric ink jet head according to claim 1, wherein the oscillator plate is made of an electrically conductive material and is formed integrally with the lower electrode of the upper and lower electrodes that sandwich the piezoelectric element on the upper and lower sides.

DESCRIPTION OF THE PREFERRED EMBODIMENTS

Figure 1:
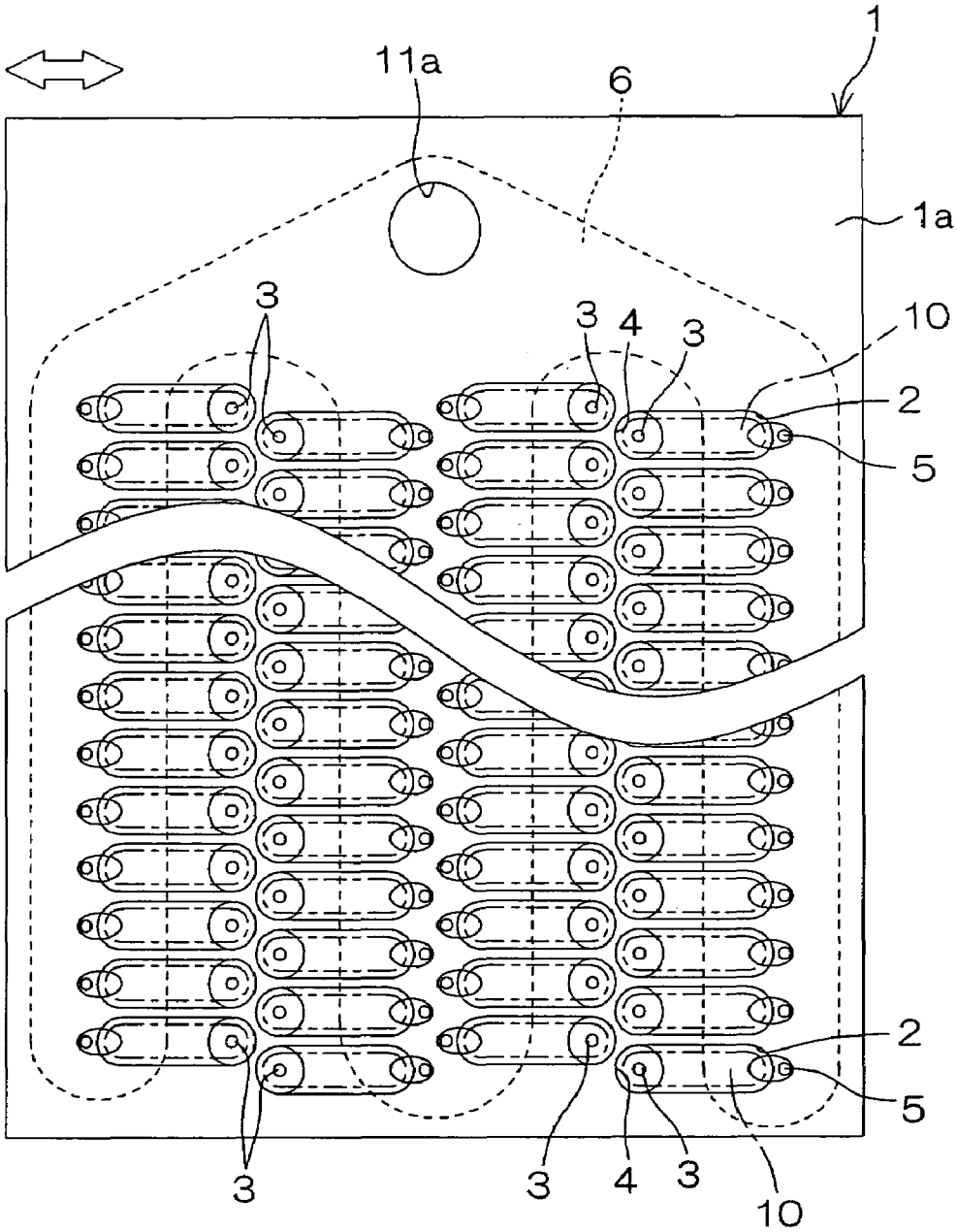
FIG. 1 is a plane view showing an example of piezoelectric ink jet head of the present invention, in a state before a drive section comprising a piezoelectric element and an oscillator plate is installed.

FIG. 1 is a plane view showing an example of the piezoelectric ink jet head of the present invention, in a state before the drive section comprising the piezoelectric element and the oscillator plate is installed.

The piezoelectric ink jet head of the example shown in FIG. 1 has a plurality of dot forming sections, each comprising a pressure chamber 2 and a nozzle 3 communicating thereto, disposed on a substrate 1.

Figure 2:
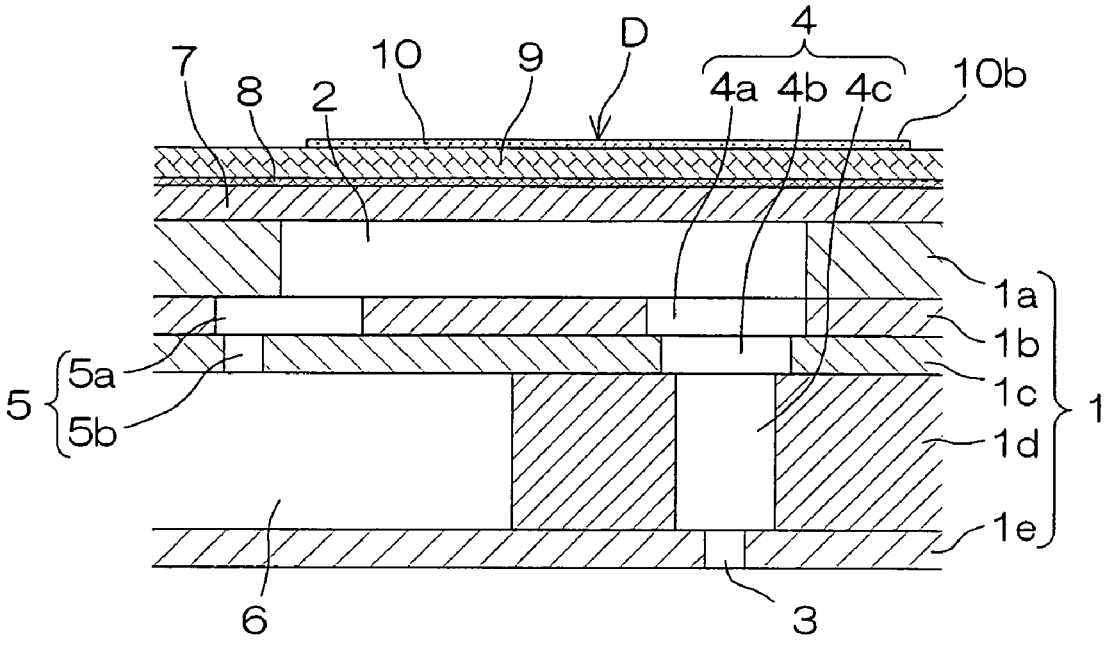
FIG. 2 is an enlarged sectional view of a dot forming section taken along lines A—A of FIG. 3 in the piezoelectric ink jet head of the example shown in FIG. 1 with the drive section installed thereon.
Figure 3:
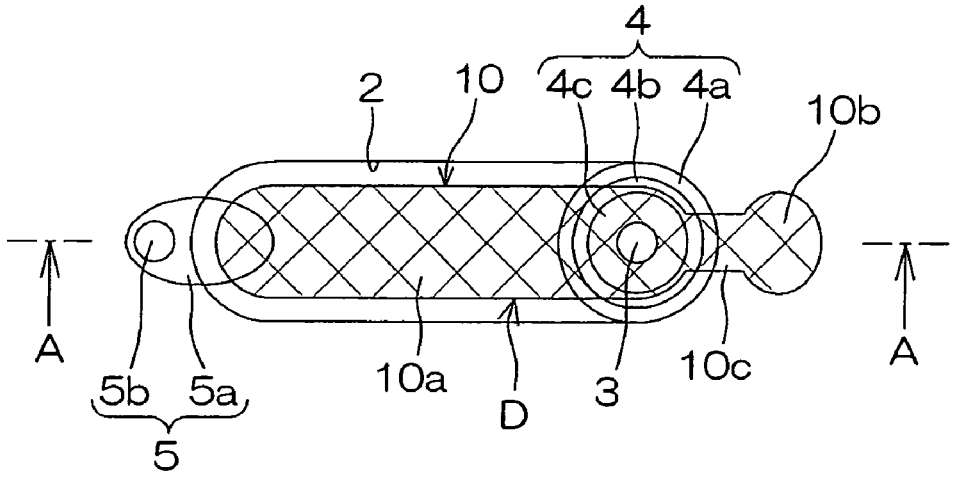
FIG. 3 is a perspective view showing the relationship between components constituting one of the dot forming sections.

FIG. 2 is an enlarged sectional view of a dot forming section in the piezoelectric ink jet head of the example described above with the drive section installed thereon. FIG. 3 is a perspective view showing the relationship between the components that constitute the dot forming section being stacked one on another.

The pressure chambers 2 and the nozzles 3 of each dot forming section are disposed in plurality along the principal scan direction indicated by the white arrow in FIG. 1. The dot forming sections are disposed in four rows, in the example shown in the figure, while the dot forming sections are arranged at a pitch of 90 dpi in the same row, thus achieving a resolution of 360 dpi in the piezoelectric ink jet head as a whole.

Each of the dot forming sections comprises the pressure chamber 2 that is a recess formed on the upper surface of the substrate 1 as shown in FIG. 2 and has a plan configuration of a rectangular mid portion interposed by semicircular portions connected to both ends thereof (refer to FIG. 3) and a nozzle 3 formed at a position that corresponds to the center of the semicircle at one end of the pressure chamber 2 on the lower surface of the substrate 1, the pressure chamber 2 and the nozzle 3 being connected with a nozzle passage 4 that has circular cross section of which diameter decreases stepwise from that of the semicircle located at the end toward the nozzle 3, while the pressure chamber 2 is connected to a common feed path 6 (indicated with dashed line in FIG. 1) that is formed so as to connect the dot forming sections in the substrate 1, via a feed port 5 formed at the other end of the pressure chamber 2.

In the example shown, the components described above have such a constitution as a first substrate 1*a* whereon the pressure chambers 2 are formed, a second substrate 1*b* whereon an upper portion 4*a* of the nozzle passage 4 and an upper portion 5*a* of the feed port 5 are formed, a third substrate 1*c* having a mid portion 4*b* of the nozzle passage 4 and a lower portion 5*b* of the feed port 5 are formed, a fourth substrate 1*d* whereon a lower portion 4*c* of the nozzle passage 4 and a common feed path 6 are formed, and a fifth substrate 1*e* whereon the nozzles 3 are formed are stacked in this order so as to form an integral structure.

The first substrate 1*a*, the second substrate 1*b* and the third substrate 1*c* have through holes 11*a* formed therein so as to constitute a joint for connecting the common feed path 6 formed on the forth substrate 1*d* and the tubing that runs from an ink cartridge which is not shown in the drawing, on the upper surface of the substrate 1, as shown in FIG. 1.

The substrates 1*a* through 1*e* are made of a resin or a metal in the form of plate of predetermined thickness having the through holes formed therein by etching using photolithography process or the like.

The substrate 1 has, on the upper surface thereof, a drive section D constituted from an oscillator plate 7 having the such an area that covers at least the dot forming sections, a thin film of common electrode 8 having substantially the same size as the oscillator plate 7, a thin plate of piezoelectric element 9 of transverse vibration mode having substantially the same size as the oscillator plate 7 and the common electrode 8 being stacked in this order, while a plurality of individual electrodes 10 are separately formed on the piezoelectric element 9 at positions that correspond to the centers of the pressure chambers 2 of the dot forming sections as indicated by dot and dash line in FIG. 1.

As shown in FIG. 3, the individual electrodes 10 are formed integrally in such a planar configuration that has electrode body 10*a* having a planar configuration similar to that of the pressure chamber 2, contact 10*b* disposed at the end of the electrode body 10*a* on the nozzle 3 side outside of the pressure chamber 2 for electrical connection and wiring section 10*c* that electrically connects both members.

The contact 10*b* is located in a solid region where the substrate 1 does not have any hollow portion formed therein such as the pressure chamber 2, the nozzle 3, the nozzle passage 4, the feed port 5 and the common feed path 6, as shown in FIG. 2.

With this constitution, the example shown in the figure provides stable vibration characteristic without variations in the vibration characteristic of the piezoelectric element 9 among the drive regions even when there are variations in rigidity and/or weight of the solder in case wiring is soldered to the contact 10*b*, or there are variations in crimping force in case connections are made by using crimp terminals.

Contact for electrically connecting the common electrode 8 is also disposed in a solid region where no cavities are formed in the substrate 1. Thus vibration characteristic of the drive regions of the piezoelectric element 9 near the contact can be prevented from varying even regardless of whether the wiring is soldered or connected by means of crimp terminals.

The drive section D constituted from the components described above can be fabricated by using a green sheet of piezoelectric material that would make a thin plate of piezoelectric material when fired.

For example, a green sheet of piezoelectric material is printed or coated on one side thereof with an electrically conductive paste that would become the common electrode when fired and, with another green sheet of piezoelectric material being stacked thereon, the stack is fired to form a laminate of such a constitution as the common electrode 8 is sandwiched by two thin piezoelectric layers. Then a plurality of individual electrodes 10 are formed on the surface of one piezoelectric layer of this laminate, and the drive section D having such a constitution is obtained as the piezoelectric layer sandwiched by the common electrode 8 and the individual electrode 10 serves as the piezoelectric element 9 and the other piezoelectric layer serves as the oscillator plate 7.

A piezoelectric material used in forming the oscillator plate 7 and the piezoelectric element 9 of the drive section D described above may be lead zirconate titanate (PZT), or PZT-based piezoelectric material made by adding one or more oxide of a metal such as lanthanum, barium, niobium, zinc, nickel or manganese to PZT, such as PLZT, for example, may be used. Lead magnesium niobate (PMN), lead nickel niobate (PNN), lead zinc niobate, lead manganese niobate, lead antimony stannate, lead titanate or barium titanate may be contained as a major component. The green sheet of the piezoelectric material contains a compound that would make some of the piezoelectric material described above when fired.

The electrically conductive paste used in forming the common electrode 8 contains powder of a metal having high electrical conductivity such as gold, silver, platinum, copper or aluminum. The common electrode 8 is formed by firing a layer of such an electrically conductive paste together with the green sheet of piezoelectric material so that the metal powder contained in the paste is sintered or melted and is integrated with the entire material.

The individual electrodes 10 may also be formed by printing an electrically conductive paste similar to that described above on the surface of one of the piezoelectric layer that would make the piezoelectric element 9, or by using a foil, plating film, vacuum vapor deposition film or the like of the metal that has high electrical conductivity such as those described above.

The oscillator plate 7 may also be formed from a metal.

For example, the oscillator plate 7 of plate shape having a predetermined thickness is formed from a single-element metal such as molybdenum, tungsten, tantalum, titanium, platinum, iron or nickel, an alloy of such metals or other metals such as stainless steel.

A green sheet of piezoelectric material similar to that described above is printed or coated on one side thereof with an electrically conductive paste that would become the common electrode when fired and is fired to form a laminate of the common electrode 8 and the thin plate of piezoelectric material. Then the oscillator plate 7 is bonded onto the surface of the laminate on the side of the common electrode 8, and a plurality of individual electrodes 10 are formed on the surface of the piezoelectric layer on the opposite side of this laminate, and the drive section D having such a constitution is obtained as the piezoelectric layer serves as the piezoelectric element 9.

The piezoelectric ink jet head is obtained by securing the drive section D, that has been integrally formed as described above, onto the substrate 1 by means of an adhesive or the like.

In order to operate the piezoelectric element 9 in transverse vibration mode, the piezoelectric material is controlled to polarize in the direction of thickness of the piezoelectric element 9, specifically in the direction from the individual electrode 10 toward the common electrode 8. For this purpose, known polarizing method may be employed such as high-temperature polarization, normal temperature polarization, alternate electric field superimposing or electric field cooling process. The piezoelectric element 9 may be subjected to aging treatment after polarization.

In the piezoelectric element 9 made of the piezoelectric material with the direction of polarization controlled as described above, the drive region sandwiched by the individual electrodes 10 and the common electrode 8 contracts within the plane perpendicular to the direction of polarization when a positive drive voltage is applied thereto from the individual electrode 10 with the common electrode 8 being grounded. Since the piezoelectric element 9 is fixed onto the oscillator plate 7 via the common electrode 8, however, the drive region that has contracted deflects toward the pressure chamber 2.

The deflection causes a change in pressure of the ink contained in the pressure chamber 2, and the change in pressure causes the ink to vibrate in the feed port 5, the pressure chamber 2, the nozzle passage 4 and the nozzle 3. As the velocity of vibration is directed toward the outside of the nozzle 3, ink meniscus in the nozzle 3 is pushed from the tip to the outside, thus forming the so-called column of ink.

While the column of ink is absorbed into the ink meniscus in the nozzle 3 as the velocity of vibration is directed toward the inside of the nozzle 3, the column of ink separates so as to form an ink droplet which flies toward the paper and forms a dot on the paper.

The body of ink of which volume has decreased by the volume of the droplet that has separated therefrom is retracted by the surface tension of the ink meniscus in the nozzle 3 so as to fill the nozzle 3 again from the ink cartridge through the tubing of the ink cartridge, the joint 11*a*, the common feed path 6, the feed port 5, the pressure chamber 2 and the nozzle passage 4.

The piezoelectric element 9 may also be formed separately for each of the pressure chamber 2, similarly to the individual electrodes 10.

Figure 4:
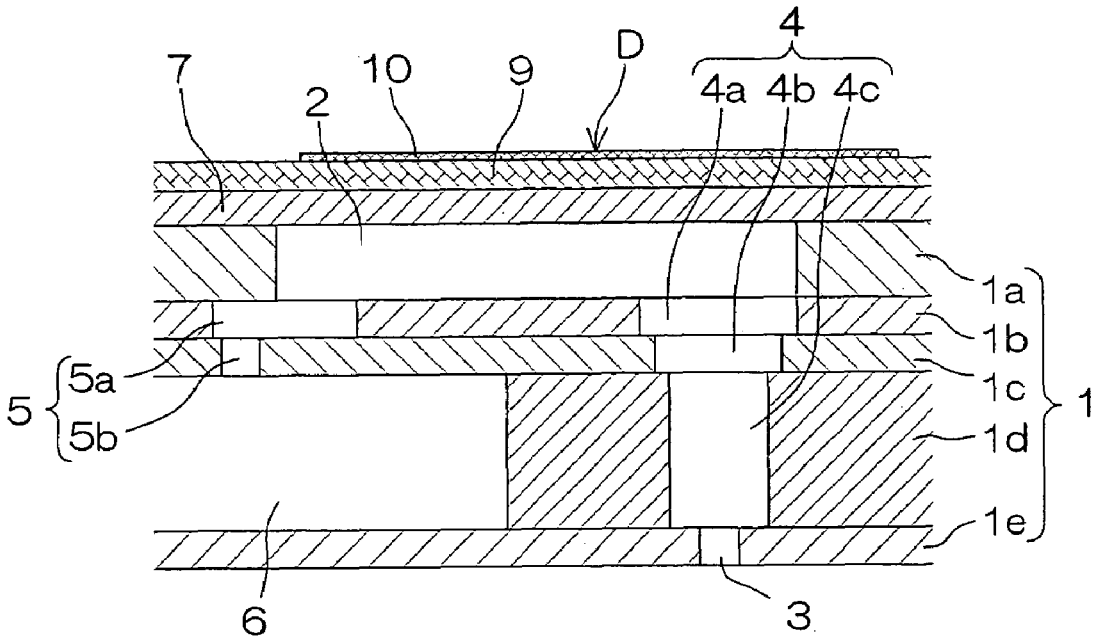
FIG. 4 is an enlarged sectional view showing a dot forming section in another example of the piezoelectric ink jet head of the present invention.

FIG. 4 is an enlarged sectional view showing a dot forming section in another example of the piezoelectric ink jet head of the present invention.

In the example shown in the figure, the common electrode 8 is omitted by forming the oscillator plate 7 from a metallic material having good electrical conductivity that can also serve as the common electrode 8. Other components are similar to those of the example shown in FIG. 2, and will therefore be identified with the same reference numbers and description thereof will be omitted.

The oscillator plate 7 is formed in plate shape having a predetermined thickness from, for example, a single-element metal such as molybdenum, tungsten, tantalum, titanium, platinum, iron or nickel, an alloy of such metals or other metals such as stainless steel.

The drive section D with a piezoelectric layer serving as the piezoelectric element 9 and the oscillator plate 7 serving also as the common electrode thereby omitting the common electrode can be made by firing the green sheet of piezoelectric material similar to that described above so as to form the piezoelectric layer of thin plate shape, then bonding the oscillator plate 7 on one side of the piezoelectric layer and forming the plurality of individual electrodes 10 on the opposite surface.

In this example, too, the piezoelectric elements 9 can be formed separately for the respective pressure chambers 2, similarly to the individual electrodes 10. In the piezoelectric ink jet head of the present invention, the ratio $t_1/t_2$ of the thickness of the piezoelectric element 9 to the thickness of the oscillator plate 7 is preferably set in a range from 1/1 to 1/4, in order to improve the vibration characteristic of the drive region of the piezoelectric element 9.

Now the drive section D of the example shown in FIG. 4 wherein the oscillator plate 7 is made of a metal and the common electrode 8 is omitted will be studied. The individual electrodes 10 are very thin films that have good plastic deformability and hardly affect the vibration characteristic of the drive regions, and therefore the individual electrodes 10 are neglected in the study. The common electrode 8 is a very thin film and has good plastic deformability similarly to the individual electrodes 10, and hardly affects the vibration characteristic of the drive regions. Therefore, the result becomes similar to that described below if the common electrode 8 is provided.

When a positive drive voltage is applied thereto from the individual electrode 10 with the oscillator plate 7 which serves also as the common electrode 8 is grounded so that the drive region of the piezoelectric element 9 located right under the individual electrode 10 contracts in the planar direction, the laminate consisting of the oscillator plate 7 and the piezoelectric element 9 deflects toward the pressure chamber 2 as described previously. In this deflected state, upper half (individual electrode 10 side) of the laminate in the direction of thickness contracts in the planar direction, while the lower half (pressure chamber 2 side) expands in the planar direction.

Figure 5A:
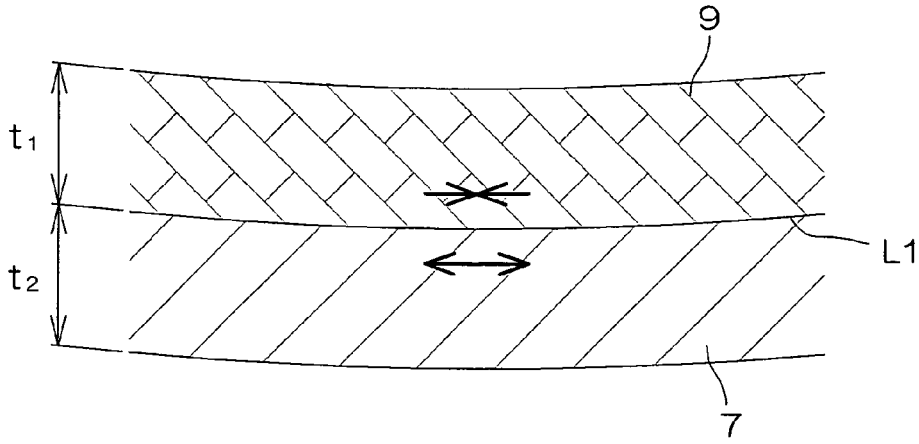
FIG. 5A through FIG. 5C are sectional views showing the changes in vibration characteristic of the drive region of the piezoelectric element when the thickness ratio of the piezoelectric element and the oscillator plate is changed.

When the oscillator plate 7 and the piezoelectric element 9 have the same thickness as shown in FIG. 5A, namely the ratio $t_1/t_2$ is 1/1, the piezoelectric element 9 as a whole is located above the center line L1 of the thickness of the laminate that corresponds to the boundary between the piezoelectric element 9 and the oscillator plate 7. As a result, the entire piezoelectric element 9 contributes to the contraction of the region above the line L1 of the laminate, so that the drive region shows the maximum deflection when the drive voltage is applied, thus demonstrating the best vibration characteristic of the drive region.

Figure 5B:
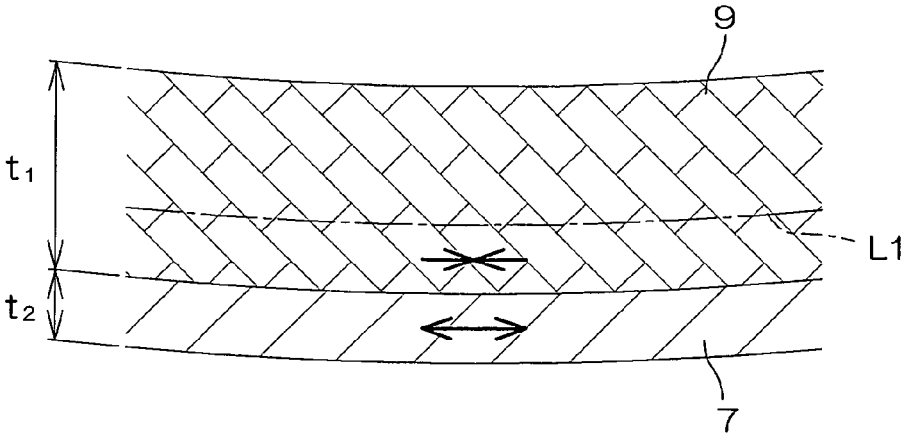

When the piezoelectric element 9 is thicker than the oscillator plate 7 as shown in FIG. 5B, namely the ratio $t_1/t_2$ is larger than 1/1, however, a part of the piezoelectric element 9 in the direction of thickness lies below the line L1 of the laminate. As a result, a part of the drive region of the piezoelectric element 9 below the line L1 contracts and causes an obstruction to the expansion of the region below the line L1, accordingly making the amount of deflection of the drive region when drive voltage is applied smaller and resulting in lower vibration characteristic.

Figure 5C:
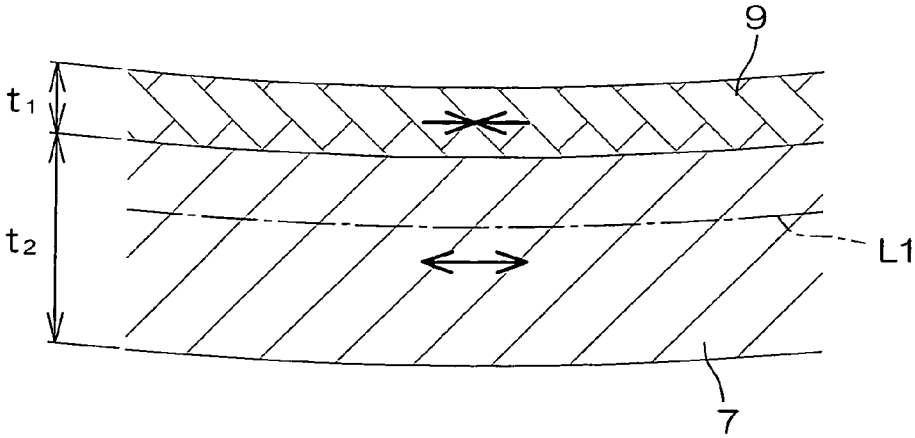

When the piezoelectric element 9 is thinner than the oscillator plate 7 as shown in FIG. 5C, namely the ratio $t_1/t_2$ is smaller than 1/1, a part of the oscillator plate 7 in the direction of thickness lies above the line L1 of the laminate. Since the oscillator plate 7 does not contribute to the contraction in the planar direction, the amount of deflection of the drive region when drive voltage is applied becomes smaller, resulting in lower vibration characteristic, as the piezoelectric element 9 becomes thinner and the part of the oscillator plate 7 in the direction of thickness above the line L1 of the laminate become thicker.

Estimate of the extent of decrease in the amount of deflection from the Young's modulus of a typical material used to form the oscillator plate 7 and the piezoelectric element 9 shows that, when $t_1/t_2=1/4$, the amount of deflection is about 40% of the amount achieved when the ratio is 1/1.

Therefore, in order to improve the vibration characteristic of the piezoelectric element 9, the thickness ratio $t_1/t_2$ is preferably set in a range from 1/1 to 1/4.

The analysis described above was carried out by maintaining the total thickness $t_1+t_2$ of the thickness $t_1$ of the piezoelectric element 9 and the thickness $t_2$ of the oscillator plate 7 constant, and controlling the applied voltage so as to maintain the electric field intensity applied to the piezoelectric element 9 constant according to the thickness $t_1$ of the piezoelectric element 9.

EXAMPLE

Example 1

A piezoelectric ink jet head having the structure shown in FIG. 1, FIG. 3 and FIG. 4 was fabricated with the pressure chamber 2 having area of 0.2 $mm^2$ and measuring 200 μm in width and 100 μm in depth, the nozzle 3 measuring 25 μm in diameter and 30 μm in length, the nozzle passage 4 measuring 200 μm in diameter in the largest section and 800 μm in length, the feed port 5 measuring 25 μm in diameter and 30 μm in length in the lower portion 5*b* and measuring 30 μm in length in the upper portion 5*a* in the thickness direction of the substrate 1, the oscillator plate 7 measuring 30 μm in thickness, the piezoelectric element 9 measuring 30 μm in thickness, and the wiring lead 10*c* that connects the electrode body 10*a* of the individual electrode 10 and the contact 10*b* measuring 50 μm in width.

The contact 10*b* was disposed in a solid region where the substrate 1 does not have any hollow portion formed therein such as the pressure chamber 2, the nozzle 3, the nozzle passage 4, the feed port 5 and the common feed path 6, as shown in FIGS. 3, 4.

The piezoelectric element 9 was formed by bonding a piezoelectric layer of thin plate shape obtained by firing a green sheet of piezoelectric material on a titanium plate used for the oscillator plate 7.

Comparative Example 1

Figure 7:
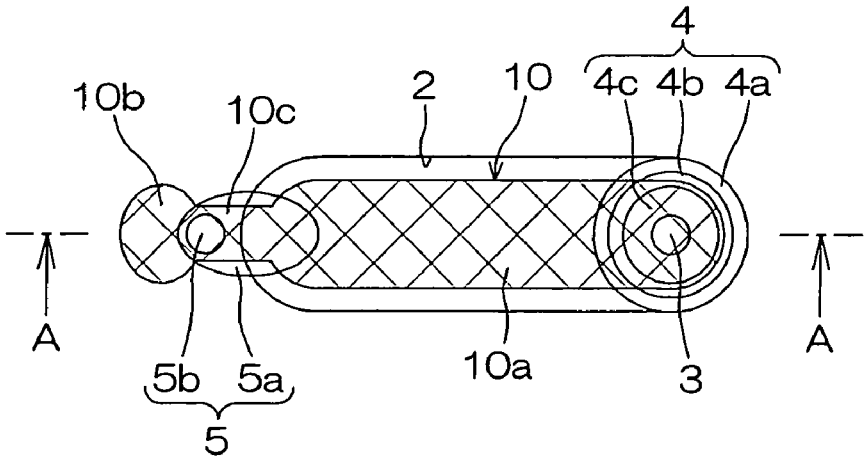
FIG. 7 is a perspective view showing the relationship between components constituting one of the dot forming sections in the example shown in FIG. 6.

A piezoelectric ink jet head was fabricated similarly to Example 1 except for forming the individual electrode 10 integrally in such a planar configuration as the electrode body 10*a*, the contact 10*b* disposed outside of the pressure chamber 2 at the end of the feed port 5 side of the electrode body 10*a* and the wiring section 10*c* that electrically connects both members as shown in FIG. 7.

Figure 6:
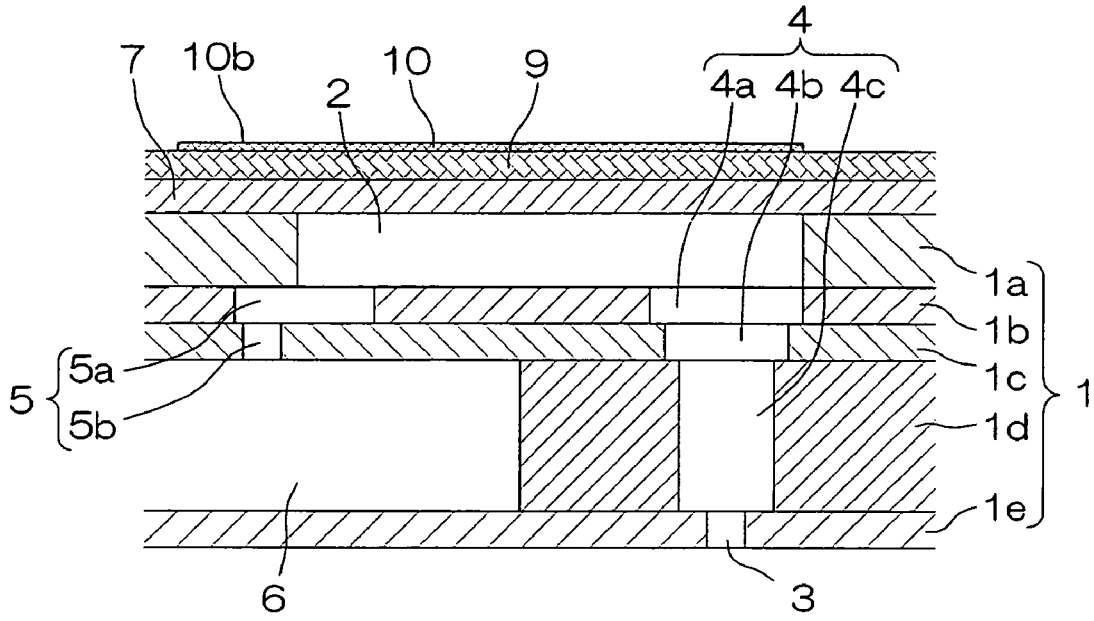
FIG. 6 is an enlarged sectional view of a dot forming section taken along lines A—A of FIG. 7 in an example of the piezoelectric ink jet head of the prior art with the drive section installed thereon.

The contact 10*b* was disposed over the common feed path 6 of the substrate 1 as shown in FIGS. 6, 7.

The contacts 10*b* of the piezoelectric ink jet heads of the example and the comparative example fabricated as described above and contacts of a flexible printed circuit board were electrically connected by heating, under pressure, solder balls placed on the latter contacts, thereby preparing 10 samples with electrical connection made by soldering each for the example and the comparative example.

Two samples out of 10 samples of the comparative example experienced cracks due to the pressure applied when making electrical connection.

Two samples among the samples without cracks experienced cracks when subjected to printing test. Remaining six samples caused disturbance in printing.

All of the ten samples of the example, in contrast, did not experience cracks in either during electrically connecting under pressure or during printing test, and did not cause disturbance in printing.

The invention claimed is:

1. A piezoelectric ink jet head comprising a plate-shaped substrate with a plurality of recesses that form pressure chambers to be filled with ink being formed in the direction of substrate surface on one side of the substrate, while nozzles for discharging the ink contained in the pressure chambers in the form of droplets are disposed so as to communicate with the respective recesses via a nozzle passages, and a common feed path is disposed to communicate via a feed port with the recesses for supplying the ink to the pressure chambers, the substrate being provided, on the surface thereof where the recesses are formed, with a drive section comprising:

a piezoelectric element made in a thin plate of transverse vibration mode;

an oscillator plate that closes the recesses so as to form the pressure chambers and oscillates as the piezoelectric element deforms thereby to decrease the capacity of some of the pressure chambers and discharge the ink from the pressure chamber through the nozzle in the form of droplet;

upper and lower electrodes that sandwich the piezoelectric element on the upper and lower sides, wherein the contacts for the electrical connection of the electrodes are positioned in a solid region of the substrate where any of recess to make the pressure chamber, common feed path, feed port, nozzle passage or nozzle is not formed; and the oscillator plate is formed to cover a plurality of dot forming sections, the piezoelectric element is formed in the same size as the oscillator plate, and a ratio $t_1/t_2$ of the thickness of the piezoelectric element $t_1$ to the thickness of the oscillator plate $t_2$ is set in a range from 1/1 to 1/4.

2. The piezoelectric ink jet head according to claim 1, wherein the oscillator plate is made of an electrically conductive material and is formed integrally with the lower electrode of the upper and lower electrodes that sandwich the piezoelectric element on the upper and lower sides.

* * * * *